US005203753A

United States Patent [19]

Rothhammer

[11] Patent Number: 5,203,753

[45] Date of Patent: Apr. 20, 1993

[54] PADDED BARBELL FLOAT

[75] Inventor: Dianne Rothhammer, Arroyo Grande, Calif.

[73] Assignee: Rothhammer International, Inc.

[21] Appl. No.: 874,692

[22] Filed: Apr. 28, 1992

[51] Int. Cl.[5] ..... A63B 21/08

[52] U.S. Cl. ..... 482/111; 482/92; 482/148; 482/106; 411/55

[58] Field of Search ..... 472/128, 129, 130; 446/220; 482/106, 107, 148, 108, 55, 92, 105, 111; 441/55, 88; 273/411, DIG. 8, 67 R

[56] References Cited

U.S. PATENT DOCUMENTS

| | | | |
|---|---|---|---|
| 1,485,577 | 3/1924 | Witten | 446/220 |
| 1,624,102 | 4/1927 | Kennedy | 441/88 |
| 2,009,551 | 7/1935 | Huebner | 441/56 |
| 2,640,696 | 6/1953 | Lemieux | 482/107 |
| 3,231,270 | 7/1962 | Winer | 482/106 |
| 3,336,029 | 8/1967 | London | 482/83 |
| 4,311,306 | 1/1982 | Solloway | 482/108 |
| 4,480,829 | 11/1984 | Yacoboski | 482/108 |
| 4,638,994 | 1/1987 | Gogarty | 482/107 |
| 4,712,792 | 12/1987 | Rogall | 482/108 |

FOREIGN PATENT DOCUMENTS

| | | | |
|---|---|---|---|
| 1170642 | 1/1959 | France | 441/55 |
| 0426891 | 4/1935 | United Kingdom | 441/55 |

*Primary Examiner*—Richard J. Apley
*Assistant Examiner*—Jerome Donnelly
*Attorney, Agent, or Firm*—Willian Brinks Olds Hofer Gilson & Lione

[57] ABSTRACT

An upper body exercising device for use while standing or sitting in water. The exercise device is a padded barbell comprised of a lightweight, water-impervious lift bar, a pliable hand grip, buoyant floats and lightweight, water-impervious float retaining collars and end caps for positioning and maintaining the floats on the lift bar. The buoyancy of the barbell provides the necessary resistance for stressing the exerciser's muscles. Because the hand grip and floats are made from a relatively soft and pliable material, i.e., closed cell expanded polymer material, any part of the barbell can be comfortably grasped and moved in the water by the exerciser to stress the upper body muscles.

7 Claims, 1 Drawing Sheet

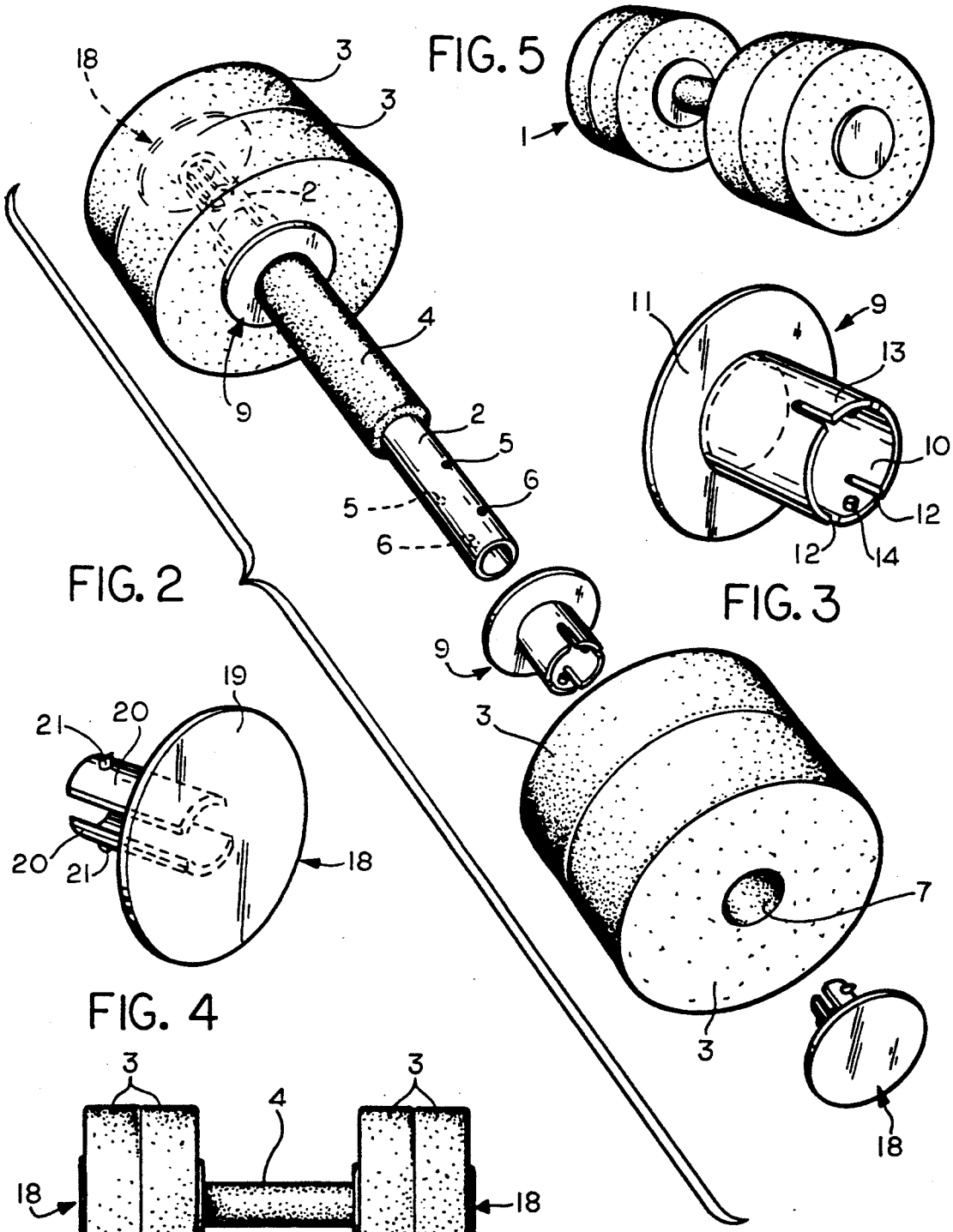
FIG. 2
FIG. 5
FIG. 3
FIG. 4
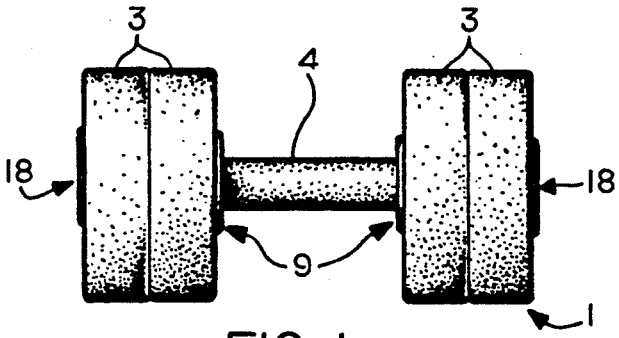
FIG. 1

PADDED BARBELL FLOAT

BACKGROUND OF THE INVENTION

This invention relates to a buoyant exercising device that is used while sitting or standing in water. The advantages of exercise performed in water are well known; it alleviates much of the stress imposed on the exerciser's joints, it increases the exerciser's caloric consumption as her body attempts to counter the cooling effect of the water, and finally, it makes the exercising experience more pleasant.

The exercising device of the present invention makes use of the above advantages of water exercise while providing a means to stress the exerciser's muscles that does not require the lifting and handling of any significant amount of weight. This aspect is especially important to those persons who desire to exercise but lack the physical strength to handle heavy weights for an extended period of time. Since the exercise device of the present invention is buoyant, the exerciser will accomplish the desired stressing of his muscles by attempting to pull or push the device below the surface of the water and by resisting the device's tendency to float to the surface. Furthermore, the buoyancy of the device will assist the exerciser in maintaining her balance while she exercises in the water.

Conventional weight resistance exercising devices are also difficult to use by those persons who lack hand dexterity, such as those persons afflicted with arthritis, since they require the exerciser to firmly grasp a hard, usually metal bar in order to employ the device. The present invention eliminates this problem by employing a padded bar and floats made from relatively soft material so that every part of the exercise device can be comfortably grasped by the exerciser.

OBJECTS OF THE INVENTION

It is an object of this invention to provide an upper body exercising device that can be used while standing or sitting in water.

It is a further object of this invention to provide a buoyant exercising device that when moved in any fashion in the water provides resistance to stress the exerciser's upper body muscles and further assists the exerciser in their balance and flotation in the water.

It is yet a further object of this invention to provide an exercising device that is constructed from relatively soft material so as to allow the exerciser to comfortably grasp any part of the device.

SUMMARY OF THE INVENTION

The exercise device of the present invention is a barbell that is comprised of a lift bar, a pliable hand grip, buoyant floats, and means for positioning and retaining the floats on the bar. The floats and hand grip are made from closed cell, expanded polymer material which causes the barbell to be buoyant in water. The other components are made from a lightweight water-impervious material, such as any plastic, so as to keep the overall weight of the barbell low and so that the barbell will not deteriorate due to its exposure to water. Because the barbell is buoyant, there will be resistance when the exerciser attempts to move the barbell through the water, thus providing the desired stressing of the exerciser's muscles. Furthermore, because all components of the barbell are relatively soft and pliable, the exerciser can comfortably grasp the barbell anywhere and attempt to move it in any fashion in order to achieve the desired exercise.

BRIEF DESCRIPTION OF THE DRAWINGS

FIG. 1 is a plan view of the padded barbell float;

FIG. 2 is a perspective view of the padded barbell float;

FIG. 3 is a perspective view of the float retaining collar;

FIG. 4 is a perspective view of the end cap; and

FIG. 5 is another perspective view of the padded barbell float.

DESCRIPTION OF THE PREFERRED EMBODIMENTS

Referring now to the drawings, the padded barbell float 1 of the present invention comprises a lift bar 2, interchangeable buoyant floats 3, two float retaining collars 9 and two end caps 18. The present invention differs from the conventional barbell in that it is used in the water, and the desired stressing of the muscles is accomplished due to the buoyancy of the barbell in the water. Thus, in order for the barbell to be buoyant, the components of the present invention must be lightweight. Furthermore, the various components must be suitable for prolonged exposure to water.

The barbell of the present invention an its specific components are best seen in FIG. 2. The lift bar 2 is a hollow, cylindrical tube, which can be of varying length depending on the number of weights desired to be placed on the bar. The lift bar has four pairs of apertures located along its length. As seen in FIG. 2, two of the pairs are closest to each end of the bar and are hereinafter denoted as the outside apertures (6). The other pairs are positioned inside of the outer pairs of apertures and toward the middle of the bar. These inner pairs of apertures are hereinafter denoted as the inside apertures 5. Each pair of apertures is comprised of two diametrically opposed holes.

A pliable hand grip 4 is placed around the middle of the lift bar, equidistant from both ends of the bar. The hand grip is a hollow, cylindrical tube made from closed cell, expanded polymer material, such as polyurethane foam. In the preferred embodiment, the grip is made from a foam-like material so as to provide a soft, comfortable surface for gripping.

The floats 3 used in the barbell of the present invention are unlike conventional barbell weights in that they are made from a lightweight, closed cell, expanded polymer material, which also has the property of being buoyant in water. As seen from FIG. 2, the floats 3 have a centrally located aperture 7, sized accordingly to allow the floats to be axially movable on the bar. In the preferred embodiment, at least two weights are positioned on the bar. The addition of more weights will make the barbell more buoyant and increase the total surface area, thus increasing the stressing of the user's muscles when trying to move the barbell through water.

Each set of buoyant floats is maintained in position on the lift bar by the combination of a float retaining collar 9 and an end cap 18. The float retaining collars 9 are made from a lightweight, water-impervious material such as any type of plastic. The float retaining collar of the present invention is shown in FIG. 3. Each float retaining collar is comprised of a toroidal plate which extends perpendicularly from the outer surface of a hollow cylindrical section. The cylindrical section has an inside diameter which allows the collar to slide axially along the lift bar. On the end of the cylindrical section opposite the toroidal plate are four slots 12 which extend in towards the toroidal plate and parallel to the major axis of the cylindrical section. A pair of these slots is adjacent each other and form an arcuate, three sided rectangular tab 13 which is flexible apart from the rest of the cylindrical section. The other pair of slots is diametrically opposite the first pair of slots and forms a similar tab. Located on the inside surface of each tab is a generally cylindrical button-like projection which extends perpendicularly from the inside surface in towards the center of the cylindrical section. These buttons are slightly smaller in diameter than the inside apertures so as to allow these buttons to fit into the inside apertures and lock the float retaining collar onto the lift bar. Each float retaining collar is positioned on the lift bar such that the end having the toroidal plate is first slid onto the bar until the tab buttons lock into the first inside pair of apertures. Thus, the toroidal plates of the two weight retaining collars will be adjacent to each other near the middle of the bar. The hand grip 4 is sized accordingly to fit between the plates of each float retaining collar. Once a float retaining collar is fitted onto an end of the lift bar, one or more buoyant floats can be slide onto the same end of the lift bar, and the toroidal plate of the collar will prevent the floats from sliding further in towards the middle of the bar.

The floats are kept from sliding off the ends of the lift bar by the end caps 18. The end caps are also made from a lightweight, water-impervious material. Each cap is comprised of a thin circular plate 19 and a generally cylindrical shaped insert section. The insert section is formed from two finger-like projections 20 which are arcuate rectangular pieces that extend perpendicularly from the plate near its center. The finger-like projections are diametrically opposed so as to form a centrally located, generally cylindrical shaped insert section. This section is inserted into an end of the lift bar so that the circular plate of each end cap will abut the outermost float on the bar.

The end cap is secured to the lift bar by two generally cylindrical shaped buttons 21 which extend perpendicularly from the outside surface of each finger-like projection near the end of the projection opposite the plate. Each button has a diameter which is slightly smaller than the outside apertures so as to allow the buttons to fit into these outside apertures. Each button also has a tapered end so that one side of the button is taller than the other side. The taller side is located on the side of the button adjacent to the plate so that the taller side will abut the side of the aperture when the end cap is pulled and prevent the end cap from being removed. The end cap can be removed by twisting the cap so that the buttons slide sideways out of the holes, thus allowing the end cap to be disengaged from the lift bar. Because the end caps are removable, the exerciser can change the number of floats as he desires.

I claim:

1. A bar bell float for exercise performed in water comprising:

a lift bar of selected length, said lift bar being made from a light weight water impervious material, said lift bar having at least two pairs of apertures located at each end of said lift bar, a pliable hand grip, said hand grip being circumjacent said lift bar and positioned equidistant from the ends of said bar, at least one float located at each end of said lift bar said floats being made from closed cell, expanded polymer material so that said float is buoyant in water, said float also having a central aperture so as to allow said float to be axially movable on said bar, at least one float retaining collar located at each end of said lift bar for limiting the axial movement of said float in towards the middle of said bar, said float retaining collar being made from a light weight, water impervious material, at least one end cap located at each end of said lift bar for limiting the axial movement of said float out towards the ends of the bar, said end cap being made from a light weight, water impervious material, means for positioning and attaching each float retaining collar to said lift bar, said means comprising two diametrically opposed, generally cylindrical buttons located on each of said float retaining collars and two diametrically opposed apertures located near each end of said lift bar, and means for positioning and attaching each end cap to said lift bar, said means comprising two diametrically opposed, generally cylindrical buttons located on each of said end caps and two diametrically opposed apertures located nearer the end of said lift bar outside of said float retaining collar apertures.

2. In the improvement of claim 1, said buttons having a taller side which abuts the side of said aperture when said means for limiting the outward axial movement of said floats is pulled so as to prevent the end cap from being removed.

3. In the improvement of claim 1, said means for limiting the outward movement of said floats being removable by twisting said means sideways so as to slide said buttons sideways out of said apertures.

4. In the barbell of claim 1, the closed cell, expanded polymer material used to make said floats and hand grip being polyurethane foam.

5. In the barbell of claim 1, the floats being disk-shaped.

6. In the barbell of claim 1, the lift bar being 12 inches in length and the total number of floats positioned on said lift bar being four.

7. In the barbell of claim 1, the lift bar being 26 inches in length and the total number of floats positioned on said lift bar being six.

* * * * *